US005270679A

United States Patent [19]

Gulbrandsen

[11] Patent Number: 5,270,679

[45] Date of Patent: Dec. 14, 1993

[54] SPLIT END PLATE FUSE ASSEMBLY

[75] Inventor: David P. Gulbrandsen, New Durham, N.H.

[73] Assignee: Gould Inc., Eastlake, Ohio

[21] Appl. No.: 14,842

[22] Filed: Feb. 8, 1993

[51] Int. Cl.[5] ..... H01H 85/143; H01H 69/02

[52] U.S. Cl. ..... 337/252; 337/248; 29/623; 439/622

[58] Field of Search ..... 337/251, 252, 253, 248, 337/254; 439/620, 621, 622; 29/623

[56] References Cited

U.S. PATENT DOCUMENTS 1,974,700 9/1934 Adams .
2,049,309 7/1936 Novak .
2,668,885 2/1954 Gerlat .
2,866,875 12/1958 Swain et al. ..... 337/252
3,300,608 1/1967 Rath ..... 337/251
3,425,023 1/1969 Krol et al. .
3,681,740 8/1972 Dumeige .
3,878,497 4/1975 Spangler .
4,138,185 2/1979 Jaconette, Jr. .

*Primary Examiner*—Harold Broome
*Attorney, Agent, or Firm*—Fish & Richardson

[57] ABSTRACT

A terminal assembly for a fuse using multiple end plate pieces to collar a terminal element around a neck portion, the end plate pieces being attached to a housing.

40 Claims, 6 Drawing Sheets

SPLIT END PLATE FUSE ASSEMBLY

BACKGROUND OF THE INVENTION

The invention relates to fuses in which ends of fusible elements are electrically connected to terminals and the fusible elements are sealed within a housing by end plates to which the terminals are attached.

It is known in the prior art to construct fuse assemblies in which a terminal piece is bolted to an end plate, and the end plate is bolted to a hollow ceramic housing. An example of such a prior art fuse 100 is shown in FIGS. 1 and 2. Terminal piece 102 consists of terminal 104, which extends through slot 103 in the end plate 106, and flange 108, which is bolted to the interior-facing surface of end plate 106. A terminal piece 102/end plate 106 assembly is bolted to each of the opposite ends of housing 110, with one or more fusible elements interconnecting the terminal pieces. The housing is usually filled with arc-quenching fill material.

SUMMARY OF THE INVENTION

In one aspect, the invention features, in general, a fuse terminal assembly that includes an end plate assembly and a terminal element. The end plate assembly is composed of two or more end plate pieces which abut each other along abutting portions of abutting edges that define a terminal hole which receives the terminal element. The terminal element has a base portion and a terminal connection portion. The base portion has two parallel, overlap portions that are spaced by the thickness of the end plate pieces and are separated by a neck portion that fits within the terminal hole and is collared by the end plate pieces. The abutting edges fit between the overlap portions, and the portions of the edges defining the terminal hole are covered by at least one overlap portion. This construction permits flexibility in using different terminal elements with different end plate assemblies and has ease of manufacture and reduced parts count advantages.

In preferred embodiments, the terminal hole has the same cross-sectional shape and size as the neck portion to provide for structural integrity; this also prevents rotation of the terminal when the shape is noncircular. The end plate pieces can abut each other in abutting edge, lap joint, overlapping angled surface, or tongue-in-groove fashion. Preferably, the terminal hole shape is a regular polygon (most preferably a square); this allows the terminal element to be oriented with respect to the plate assembly (and thus components on it, such as a blown fuse indicator mounting tab) in as many angular orientations as there are sides of the polygon. The base portion has one or more contact areas to which fusible elements are attached. The contact areas may be axially-spaced, concentric surfaces, which provide for flexibility in terms of arrangement of the fusible elements. The contact areas can have crowned surfaces to assist in welding. The terminal connection portion of the terminal element can be a notched blade or other configuration such as a threaded receptacle or a plurality of pin engagement holes.

Two such terminal assemblies are preferably used to seal openings on opposite sides of a hollow housing of a fuse, and fusible elements disposed within the housing are attached to the contact areas of the terminal element. The housing is preferably ceramic. The housing preferably contains arc quenching fill, most preferably a solid fill.

In another aspect, the invention features, in general, a method of making a fuse employing split end plate pieces collared in base portions of terminal elements. Fusible elements are connected to the contact areas of two terminal elements to form a subassembly. One of the terminal elements is collared with a first set of end plate pieces. The subassembly is inserted into one opening of the housing, non-collared terminal first, until the first end plate pieces contact the housing, and the non-collared terminal protrudes through a second opening of the housing. The first end plate pieces are affixed to the housing to seal the first opening, preferably by screws. The non-collared terminal is collared with a second set of end plate pieces which are affixed to the housing to seal the second opening. Where the housing is filled with arc-quenching fill material, it can be introduced before the second plate pieces have been attached, or it can be injected through fill holes after the second plate pieces have been attached. The fill material can bound with cured liquid binder material to provide a solid fill, if desired.

Other advantages and features of the invention will be apparent from the following description of the preferred embodiment thereof and from the claims.

DESCRIPTION OF THE PREFERRED EMBODIMENTS

Figure 1:
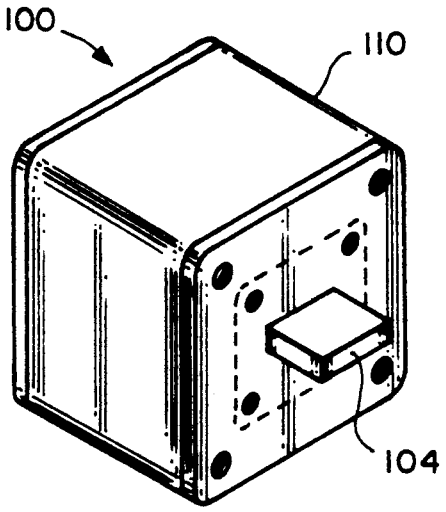
FIG. 1 (PRIOR ART)
FIGS. 1 is perspective view of a prior art fuse.
Figure 2:
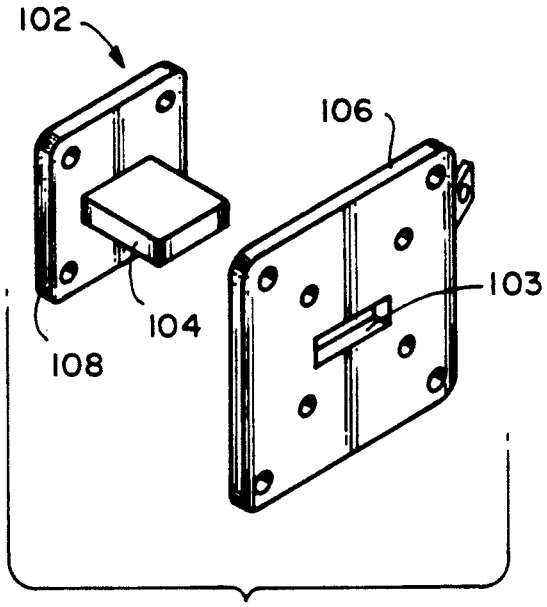
FIG. 2 (PRIOR ART)
FIG. 2 is an exploded perspective view of a terminal assembly of the FIG. 1 fuse.
Figure 3:
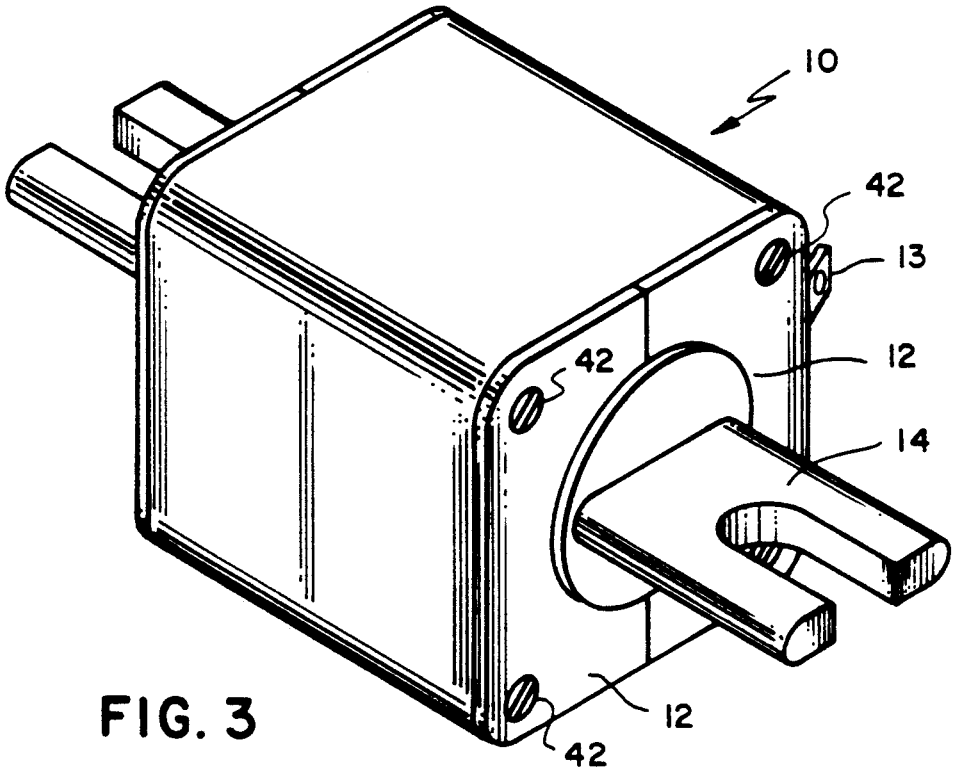
FIG. 3 is a perspective view of a fuse according to the invention.
Figure 5:
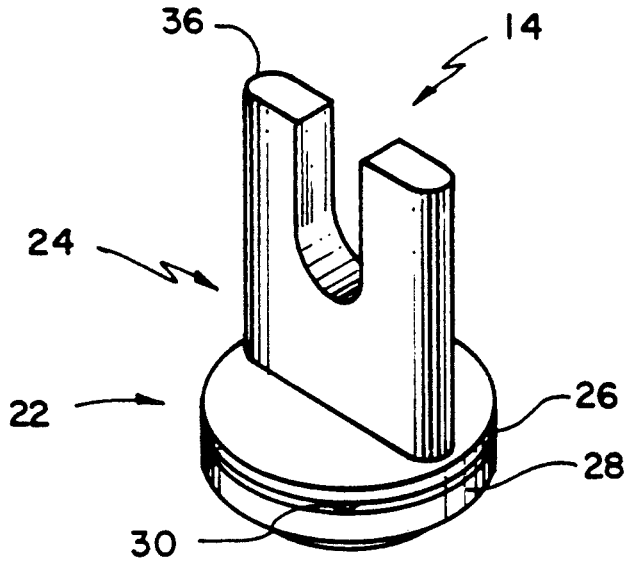
FIG. 5 is a perspective view of a terminal element of the FIG. 3 fuse.
Figure 4:
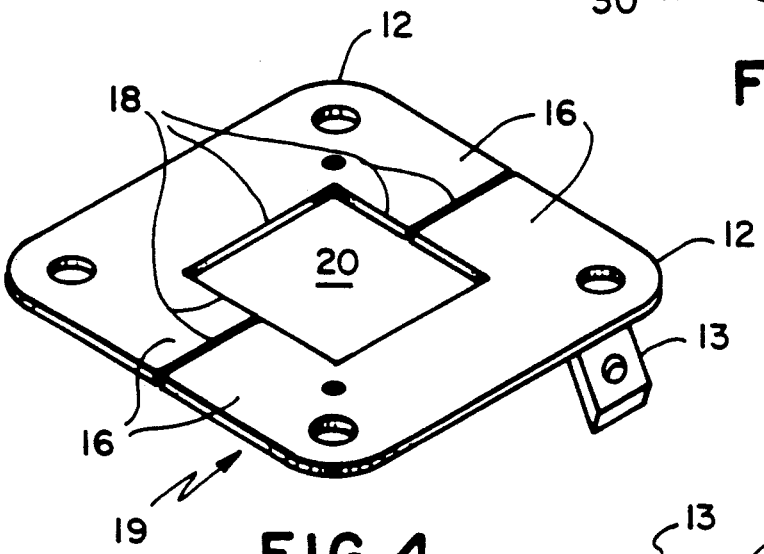
FIG. 4 is a perspective view of mating end plate pieces of the FIG. 3 fuse.
Figure 8:
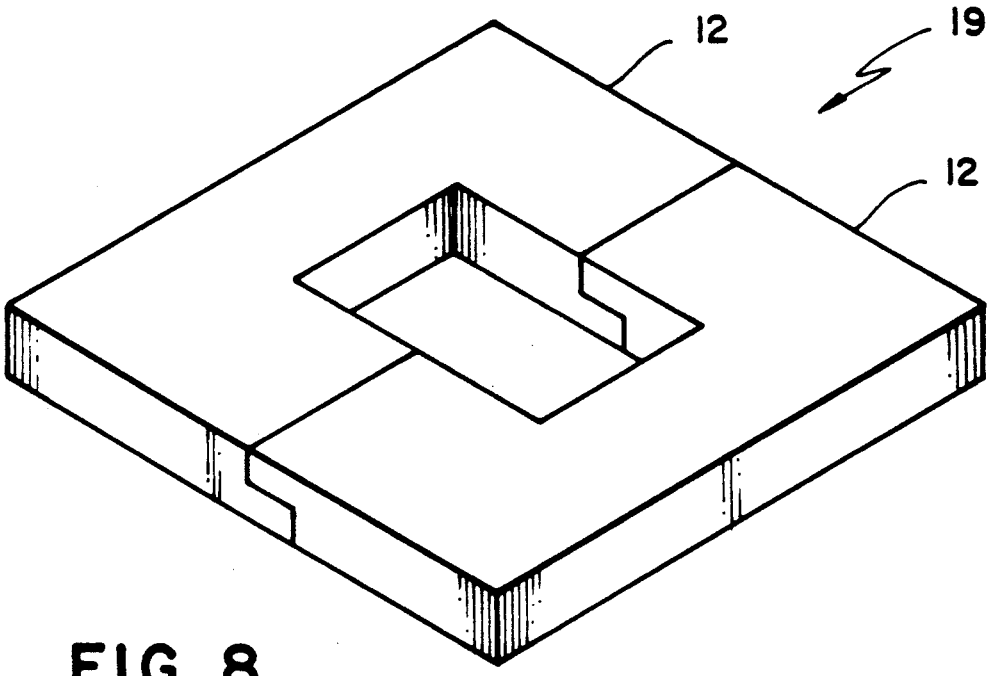
FIGS. 8, 9, and 10 are perspective views showing alternative end plate pieces for use in the FIG. 3 fuse.
Figure 9:
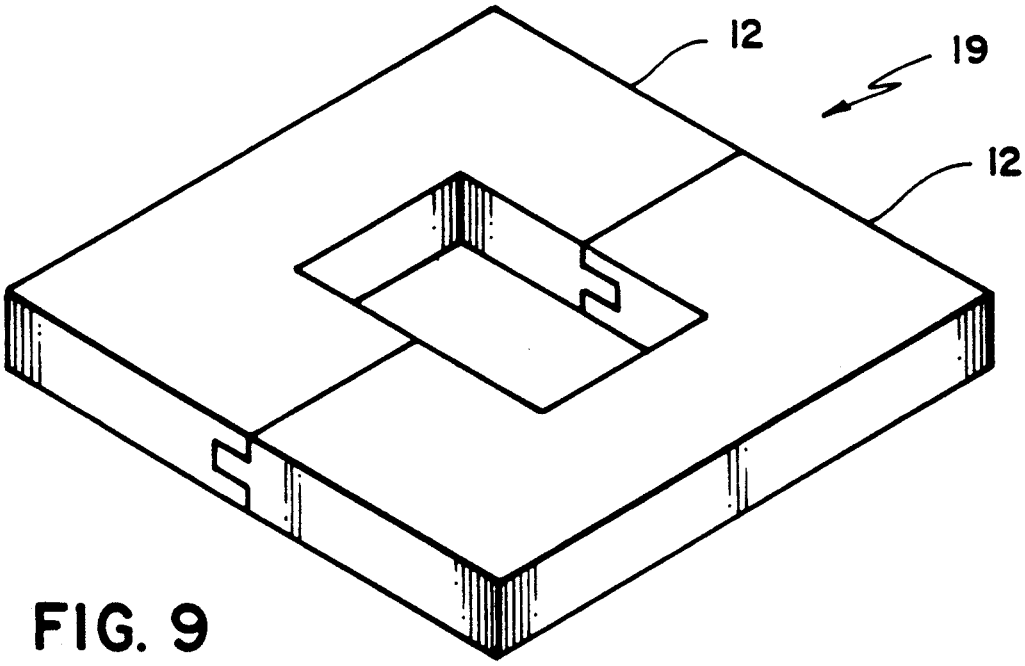
Figure 10:
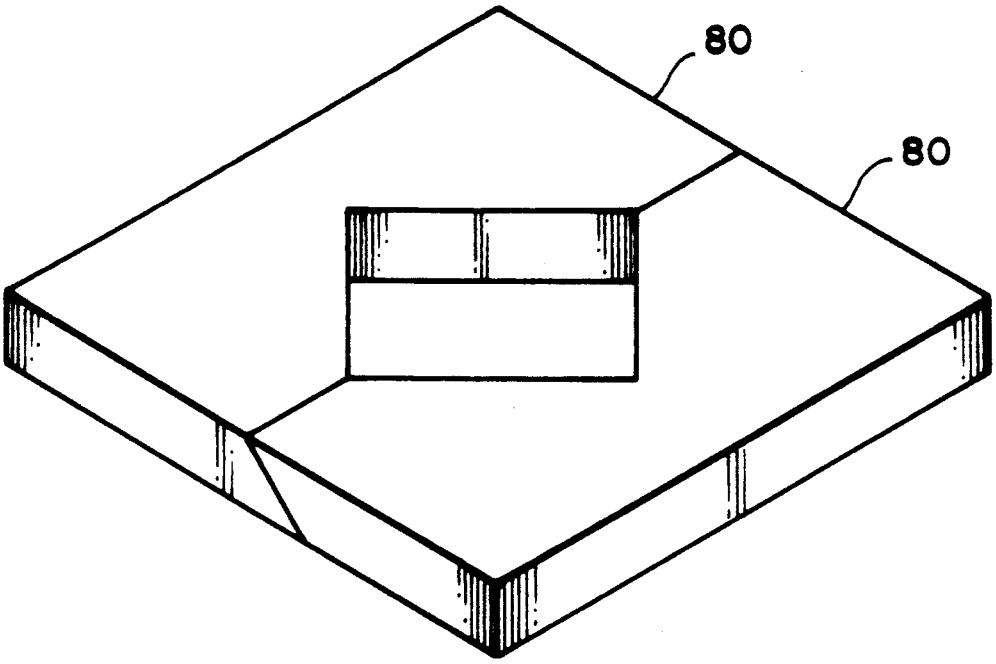

Referring to FIGS. 3–7, fuse 10 utilizes an end plate composed of two or more end plate pieces 12, preferably fabricated from sheet metal (preferably a nonferrous material, e.g., brass, aluminum, or stainless steel), which collar terminal element 14. One end plate piece 12 carries tab 13 for mounting a blown fuse indicator in desired orientation. End plate pieces 12 abut each other along abutting portions 16 of abutting edges 18 to form end plate assembly 19 (FIG. 4). They should all have substantially the same plate thickness, at least along abutting edges 18. They are fabricated such that, when they abut each other, abutting edges 18 define terminal hole 20. The abutting portions 16 can mate in a lap joint fashion, as in FIG. 8. Alternatively, abutting portions 16 could mate in tongue-in-groove fashion, as in FIG. 9, or in angled surface fashion, as in FIG. 10. The abutting portions could also be perpendicular, flat surfaces, as in FIGS. 3, 4, and 6.

Terminal element 14 (FIG. 5) has base portion 22 and a terminal connection portion 24. Base portion 22—preferably brass—has two parallel overlap portions 26, 28 which are spaced apart by neck portion 30. (See FIGS. 5 and 7.) Overlap portions 26, 28 are spaced by a distance substantially equal to the plate thickness of end plate pieces 12 along abutting edges 18. The entire terminal element is preferably silver plated for desirable conducting properties.

Neck portion 30 is of the same cross-sectional shape and size as terminal hole 20. Preferably, they are square. Because overlap portions 26, 28 are spaced by a distance substantially equal to the plate thickness of end plate pieces 12 along abutting edges 18, end plate pieces 12 fit between overlap portions 26, 28 in a snug fit and collar terminal element 14 around neck portion 30 (FIG. 6).

Base portion 22 has one or more fusible element contact areas 32 to which fusible elements 34 are attached. The fusible elements are preferably formed as flat strips of silver. Contact areas 32 may be concentric, axially spaced surfaces (FIG. 6), one of which may be the outer surface of overlap portion 28.

Figure 11:
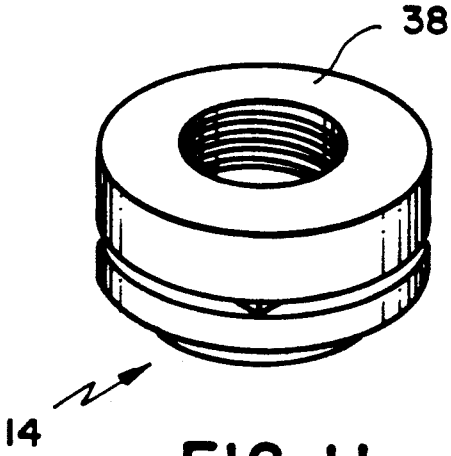
FIGS. 11, 12, and 13 are perspective views of alternative terminal elements for use in the FIG. 3 fuse.
Figure 12:
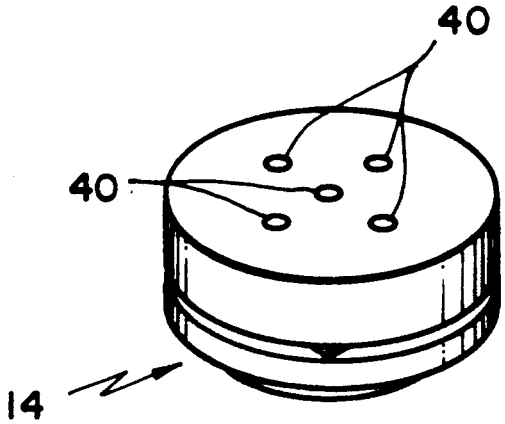

Terminal connection portion 24 is used to connect fuse 10 into a circuit requiring fuse protection. Terminal connection portion 24 may be formed as notched blade 36 (FIG. 5), which is brazed to the base portion. When so configured, the terminal connection portion is preferably copper. Because neck portion 30 and terminal hole 20 are square, blade 36 can be oriented in any of four positions with respect to terminal tab 13, depending upon the requirements of the application, without specially manufacturing different terminal assemblies. (Because the notch on blade 36 extends along the axis, there are two pairs of identical orientations.) The blades could be continuous, have notches in other orientations, or have circular or other shape openings. Also, where the specific application so requires, the terminal connection portion may be threaded receptacle 38 (FIG. 11), or two such threaded receptacles, or it may consist of a plurality of pin engagement holes 40 (FIG. 12). With the latter type of terminal connection, external pressure is applied to the contact members engaging the terminals, and locator pins mate with pin engagement holes 40. Because these different terminal elements all have the same shape and size neck portion but differing terminal connection portions, the same end plate assembly may be used for all of them, also reducing part inventory and permitting flexibility. Thus, a distinct advantage of the invention is part interchangeability.

Figure 6:
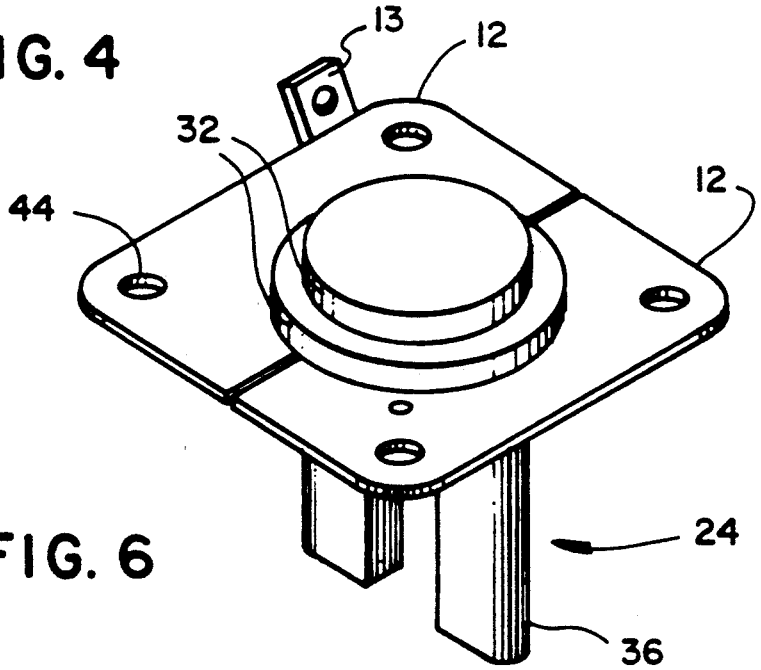
FIG. 6 is a perspective view of a terminal assembly made of the FIG. 4 end plate pieces and the FIG. 5 terminal element.
Figure 7:
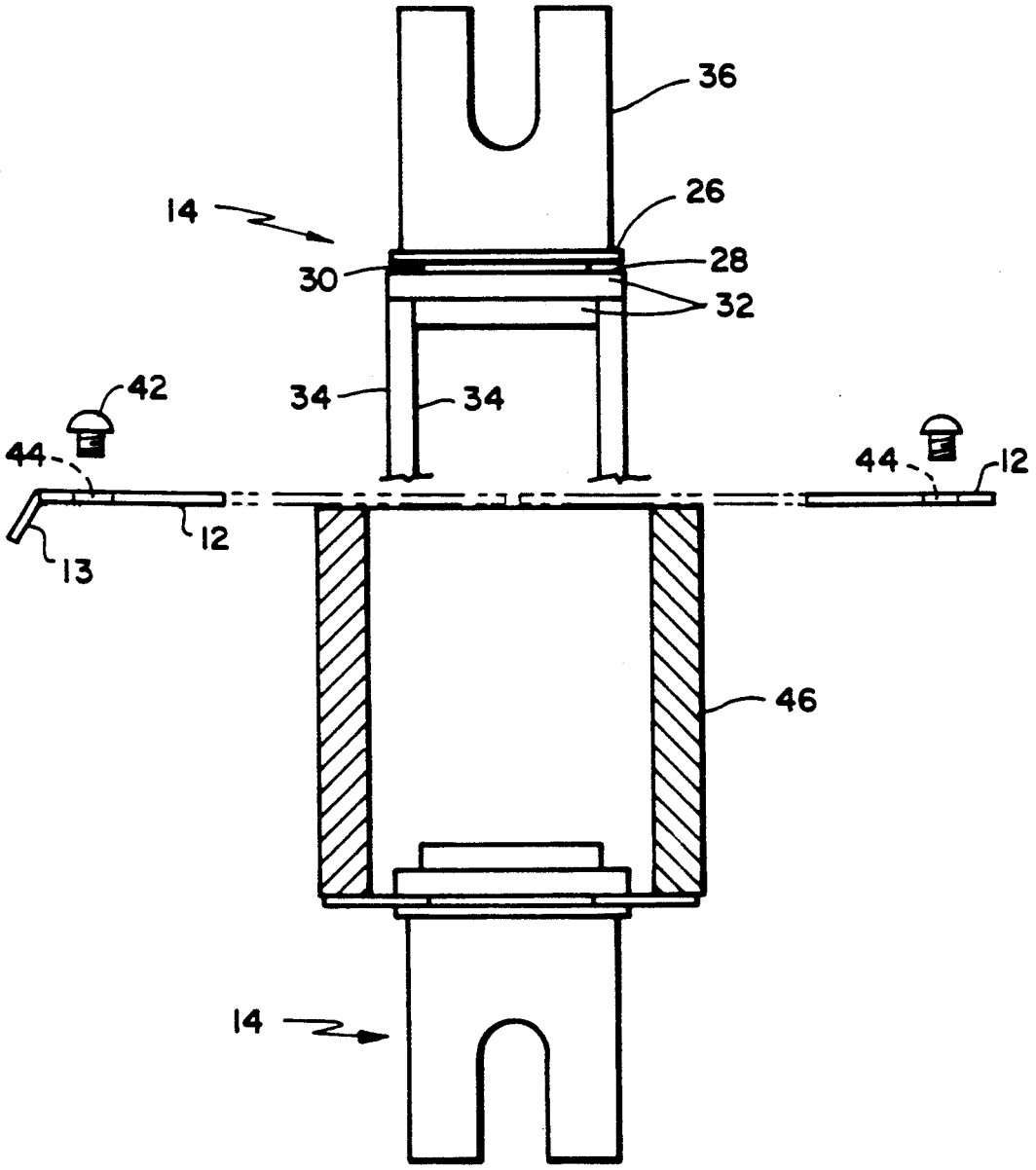
FIG. 7 is an exploded elevation, partially in section, of the FIG. 3 fuse with fusible elements broken out.

Referring to FIGS. 6 and 7, end plate pieces 12 collar terminal element 14 around neck portion 30 to form a terminal assembly. Hollow ceramic housing 46 has an opening in each end. A terminal assembly is affixed with screws 42, through screw holes 44 in end plate pieces 12, to each end of housing 46 so as to cover and seal the openings. Housing 46 and end plate assembly 19 are both preferably square. Base portions 22 of terminal elements 14 are located inside housing 46, and fusible elements 34 attached to contact areas 32 interconnect terminal elements 14. Arc-quenching fill material (not shown) fills any open spaces within the interior of the sealed housing. It may be loose, such as quartz sand, or solid, such as sand bound with sodium silicate.

Figure 14:
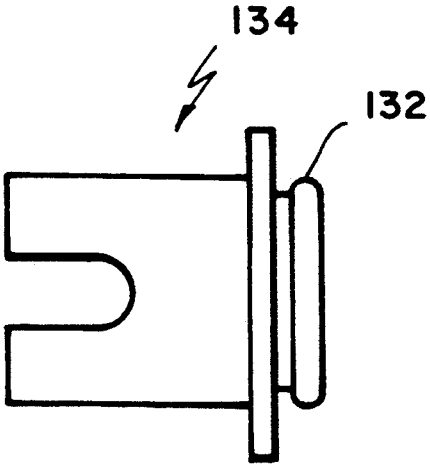
FIGS. 14 and 15 are a front elevation and a side elevation of an alternative terminal element according to the invention.

In manufacture, a plurality of fusible elements 34 are preferably welded to the contact areas 32 of two terminal elements 14 to interconnect terminal elements 14 and form a subassembly. The contact area can have a crowned shape, as shown for contact area 132 on terminal element 132 in FIG. 14 to facilitate welding. Alternatively, in certain limited applications, fusible elements 34 may be soldered to contact areas 32. The number of fusible elements 34 used depends on the dimensions of the fusible elements 34 and the particular amperage requirements for the fuse.

End plate pieces 12 are inserted around neck portion 30 of a first one of the interconnected terminal elements 14, and the subassembly is inserted through housing 46 until end plate pieces 12 contact housing 46. End plate pieces 12 are then affixed to housing 46 with screws 42.

The arc-quenching fill can be introduced before or after attaching the second set of end plate pieces. If introduced after, it is done by injecting loose fill material (e.g., quartz sand) into housing 46 through fill holes 48. Fill holes 48 are then plugged with plugs (not shown). When the fill material is bound in a solid fill, as with sodium silicate, sand already introduced into the housing (before or after attaching the second set of end plate pieces) is soaked with a liquid bath of the sodium silicate, which wicks through the sand and is then cured.

The use of the split end plates to collar the terminal element thus avoids the use of self-tapping screws to hold the two together, greatly simplifying the assembly process and avoiding metal chips that might enter the interior of the fuse housing when self-tapping screws are used, as in some prior art constructions.

OTHER EMBODIMENTS

Other embodiments of the invention are within the scope of the following claims. E.g., the end plate assembly may be composed of more than two end plate pieces.

Figure 13:
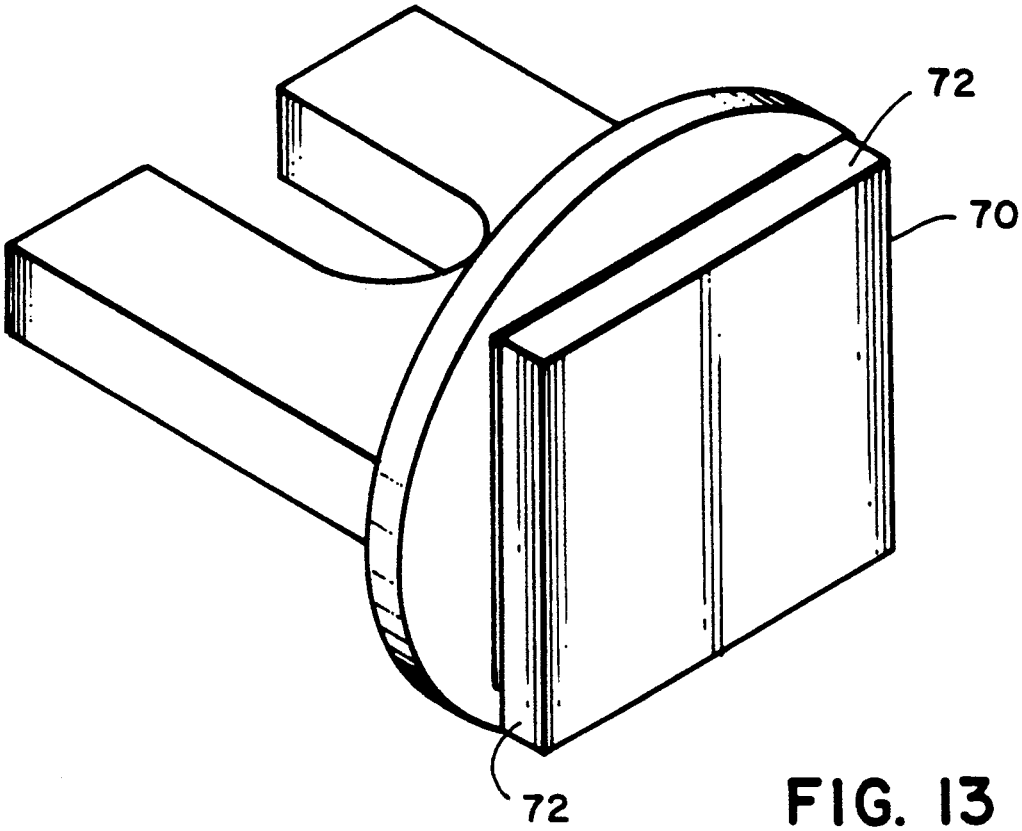
Figure 15:
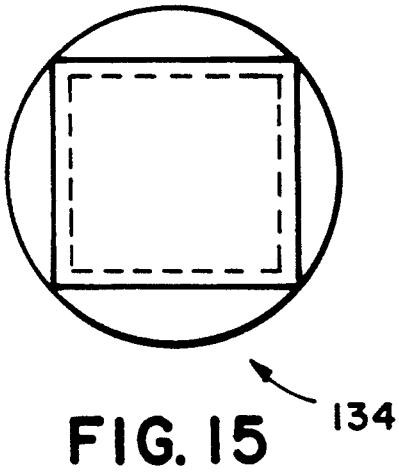

The base portion could have noncircular contact areas for attaching the ends of the fusible element, e.g., square, single-step portion 70, providing rectangular contact areas 72, as shown in FIG. 13 (and also in FIG. 15 for terminal element 134). Also, there could be one, two, or even three or more steps for securing the ends of fusible elements, though, as the number of steps increases, the lengths of the fusible elements decrease. Other polygons and other shapes could be used to provide contact areas.

Also, the terminal hole need not necessarily be square. Preferably the shape is non-circular, so as to prevent the terminal element from rotating and potentially damaging the fusible elements. This could even be a partial circle with a flat edge or a full circle with a tab extending into the circle that mates with a recess in the neck. Also, circular sections could be used, with pins extending between holes through the overlap portions and holes through the plate pieces to prevent rotation. Furthermore, any regular polygon shape may be used. This allows as many angular orientations of the terminal as there are sides of the polygon. The end plate pieces may overlap in other fashions as well. Also, a square hole could be arranged in a diamond configuration, as in plate pieces 80 shown in FIG. 10.

It is also possible for the terminal hole to have a different shape than the neck portion, so long as the terminal hole is covered by areas on one or both overlapping portions, and the terminal element is secured and prevented from rotation. E.g., an octagon-shaped neck portion could fit within a square having the same distance between opposite sides as the octagon. Also, the overlapping portions do not need to have the same shape (as shown in FIGS. 13 and 15) and also do not need to be continuous, so long as the hole is covered. E.g., one or the other of the overlapping portions could be a series of tabs of sufficient number to prevent the terminal element from moving.

The housing need not be square but could be circular, another polygonal shape, or generally any shape. Also, the housing could be made of other materials, such as plastic, in which case pop rivets could be used to secure the end plates to the housing.

What is claimed is:

1. An electrical fuse terminal assembly comprising an end plate assembly, and a terminal element received in said end plate assembly, said end plate assembly comprising two or more end plate pieces abutting each other along abutting portions of abutting edges and having substantially the same plate thickness along said abutting edges, said abutting edges defining a terminal hole which receives said terminal element, said terminal element comprising a base portion and a terminal connection portion, said base portion comprising two parallel overlap portions spaced a distance by a neck portion, said distance being substantially equal to the plate thickness of the end plate pieces, and said neck portion fitting within said terminal hole and being collared by said end plate pieces, said abutting edges fitting between said overlap portions, the portions of the edges defining said hole being covered by a said overlap portion.

2. The electrical fuse terminal assembly of claim 1 wherein said neck portion is of the same cross-sectional shape and size as said terminal hole.

3. The electrical fuse terminal assembly of claim 1 wherein said end plate assembly is generally square.

4. The electrical fuse terminal assembly of claim 1 wherein the abutting portions of the abutting edges comprise coordinating overlap surfaces such that the end plate pieces abut each other in overlapping fashion.

5. The electrical fuse terminal assembly of claim 1 wherein the abutting portions of the abutting edges comprise coordinating tongue and groove features such that the end plate pieces abut each other in tongue-in-groove fashion.

6. The electrical fuse terminal assembly of claim wherein the abutting portions of the abutting edges are flat surfaces at nonperpendicular angles to the faces of the plate pieces.

7. The electrical fuse terminal assembly of claim 1 wherein the abutting portions of the abutting edges are flat surfaces that are perpendicular to the faces of the plate pieces.

8. The electrical fuse terminal assembly of claim 2 wherein said terminal hole is non-circular such that said terminal element is restrained from rotating within said terminal hole.

9. The electrical fuse terminal assembly of claim 8 wherein said terminal hole is generally polygonal.

10. The electrical fuse terminal assembly of claim 9 wherein said terminal hole is regularly polygonal such that said terminal element may be received in said terminal hole in a plurality of angular orientations.

11. The electrical fuse terminal assembly of claim 10 wherein said terminal hole is generally square.

12. The electrical fuse terminal assembly of claim 1 wherein the base portion of the terminal element further comprises one or more fusible element contact areas.

13. The electrical fuse terminal assembly of claim 12 wherein contact areas have crowned surfaces.

14. The electrical fuse terminal assembly of claim 12 wherein said fusible element contact areas comprise a plurality of axially spaced concentric surfaces.

15. The electrical fuse terminal assembly of claim 12 wherein said fusible element contact areas comprise the side surfaces of a square projection on said base portion.

16. The electrical fuse terminal assembly of claim 1 wherein the terminal connection portion of the terminal element is a blade.

17. The electrical fuse terminal assembly of claim 15 wherein said blade is notched.

18. The electrical fuse terminal assembly of claim 17 wherein said blade has a hole through it.

19. The electrical fuse terminal assembly of claim 1 wherein the terminal connection portion of the terminal element is one or more threaded receptacles.

20. The electrical fuse terminal assembly of claim 1 wherein the terminal connection portion of the terminal element has a plurality of pin engagement holes.

21. An electrical fuse comprising a hollow housing comprising a first opening, a first terminal assembly affixed to said housing at said first opening and covering said first opening, said first terminal assembly comprising a first end plate assembly, and a first terminal element received in said first end plate assembly, and one or more fusible elements connected to said first terminal element and disposed within said housing, said first end plate assembly comprising two or more end plate pieces abutting each other along abutting portions of abutting edges and having substantially the same plate thickness along said abutting edges, said abutting edges defining a terminal hole which receives said terminal element, said first terminal element comprising a base portion and a terminal connection portion, said base portion comprising two parallel overlap portions spaced a distance by a neck portion, said distance being substantially equal to the plate thickness of the end plate pieces, and said neck portion fitting within said terminal hole and being collared by said end plate pieces, said abutting edges fitting between said overlap portions, the portions of the edges defining said hole being covered by a said overlap portion.

22. The fuse terminal assembly of claim 21 wherein said neck portion is of the same cross-sectional shape and size as said terminal hole.

23. The electrical fuse of claim 21 wherein said housing further comprises a second opening opposing said first opening, said electrical fuse further comprises a second terminal assembly affixed to said housing at said second opening and covering said second opening, said second terminal assembly comprising a second end plate assembly, and a second terminal element affixed to said second end plate assembly, and said one or more fusible elements interconnect said first and second terminal elements.

24. The electrical fuse of claim 23 wherein said housing is ceramic, and further comprising arc-quenching fill material contained within said housing.

25. The electrical fuse of claim 23 wherein said housing is generally square.

26. The electrical fuse of claim 25 wherein said first and second end plate assemblies are generally square.

27. The electrical fuse of claim 26 wherein said terminal hole is generally square.

28. The electrical fuse of claim 27 wherein said end plate assemblies carry tabs for mounting a blown fuse indicator on said fuse.

29. The electrical fuse of claim 21 wherein said first end plate assembly is affixed to said housing by screws.

30. The electrical fuse of claim 23 wherein said first and second end plate assemblies are affixed to said housing by screws.

31. The method of making an electrical fuse comprising the steps of providing first and second terminal elements, each of said terminal elements comprising a base portion and a terminal connection portion, said base portion comprising two parallel overlap portions spaced a distance by a neck portion and further comprising one or more fusible element contact areas, electrically conductively attaching one or more fusible elements to said fusible element contact areas of said first and second terminal elements so as to interconnect said first and second terminal elements to form a subassembly, inserting abutting edges of a first set of two or more end plate pieces between the overlap portions of said first terminal element so as to collar said first terminal element around its neck portion, providing a hollow housing, said housing having a cavity and a first and a second opening at opposing ends in communication with said cavity, disposing said subassembly in said cavity by inserting said subassembly through said first opening, second terminal first, until said first set of end plate pieces contact said housing and said second terminal element protrudes through said second opening, affixing said first set of end plate pieces to said housing, inserting abutting edges of a second set of two or more end plate pieces between the overlap portions of said second terminal element so as to collar said second terminal element around its neck portion, and affixing said second set of end plate pieces to said housing.

32. The method of claim 31 further comprising filling said cavity with arc-quenching fill material.

33. The method of claim 32 wherein said step of filling said cavity comprises injecting loose fill material through fill holes in said end plate pieces after said first and second sets of end plate pieces have been affixed to said housing.

34. The method of claim 32 wherein said step of filling said cavity is performed before said second terminal element is collared by said second set of end plate pieces.

35. The method of claim 33 wherein said arc-quenching fill material is solid fill and further comprising soaking said loose fill material with a liquid bath of binder material which wicks into said loose fill material and cures to bind said loose fill material.

36. The method of claim 34 wherein said arc-quenching fill material is solid fill, and wherein said filling includes filling with loose fill material and soaking said loose fill material with a liquid bath of binder material which wicks into said loose fill material and cures to bind said loose fill material.

37. The method of claim 35 wherein said solid fill comprises quartz sand and cured sodium silicate.

38. The method of claim 36 wherein said solid fill comprises quartz sand and cured sodium silicate.

39. The method of claim 31 wherein said step of attaching fusible elements to said fusible element contact areas comprises welding.

40. The method of claim 31 wherein said step of attaching fusible elements to said fusible element contact areas comprises soldering.

* * * * *